US008336439B2

(12) United States Patent
St. Claire et al.

(10) Patent No.: US 8,336,439 B2
(45) Date of Patent: Dec. 25, 2012

(54) LAYERING NON-METALLIC LAYERS BETWEEN METALLIC LAYERS TO IMPROVE ARMOR PROTECTION

(75) Inventors: Alexander F. St. Claire, Dallas, TX (US); Timothy J. Imholt, Methuen, MA (US)

(73) Assignee: Raytheon Company, Waltham, MA (US)

( * ) Notice: Subject to any disclaimer, the term of this patent is extended or adjusted under 35 U.S.C. 154(b) by 183 days.

(21) Appl. No.: 12/652,309

(22) Filed: Jan. 5, 2010

(65) Prior Publication Data

US 2011/0162515 A1 Jul. 7, 2011

(51) Int. Cl.
*F41H 5/04* (2006.01)

(52) U.S. Cl. ..... 89/36.02; 89/903; 89/910; 89/912; 89/917

(58) Field of Classification Search ..... 89/36.01, 89/36.02, 36.04, 36.05, 36.07, 36.08, 36.09, 89/36.17

See application file for complete search history.

(56) References Cited

U.S. PATENT DOCUMENTS

| | | | | |
|---|---|---|---|---|
| 2,279,110 | A * | 4/1942 | Collins | 109/82 |
| 4,404,889 | A * | 9/1983 | Miguel | 89/36.02 |
| 4,664,967 | A * | 5/1987 | Tasdemiroglu | 428/220 |
| 4,895,063 | A * | 1/1990 | Marlow et al. | 89/36.02 |
| H001061 | H * | 6/1992 | Rozner et al. | 89/36.02 |
| 5,214,235 | A * | 5/1993 | Froeschner | 89/36.13 |
| 5,824,941 | A * | 10/1998 | Knapper | 89/36.17 |
| 7,069,836 | B1 * | 7/2006 | Palicka et al. | 89/36.02 |
| 7,104,178 | B1 * | 9/2006 | Zank | 89/36.17 |
| 7,938,053 | B1 * | 5/2011 | Dudt et al. | 89/36.02 |
| 2004/0050239 | A1 * | 3/2004 | Benyami et al. | 89/36.17 |
| 2006/0191403 | A1 * | 8/2006 | Hawkins et al. | 89/36.05 |
| 2007/0144337 | A1 * | 6/2007 | Zhang et al. | 89/36.01 |
| 2009/0293709 | A1 * | 12/2009 | Joynt et al. | 89/36.02 |

* cited by examiner

*Primary Examiner* — Bret Hayes
(74) *Attorney, Agent, or Firm* — Renner, Otto, Boisselle & Sklar, LLP

(57) ABSTRACT

According to one embodiment, an armor system comprises a plurality of metallic layers. The armor system further comprises a plurality of non-metallic layers located in between two or more metallic layers of the plurality of metallic layers, such that each non-metallic layer is located at a respective depth in the plurality of metallic layers.

6 Claims, 3 Drawing Sheets

LAYERING NON-METALLIC LAYERS BETWEEN METALLIC LAYERS TO IMPROVE ARMOR PROTECTION

TECHNICAL FIELD

This invention relates generally to the field of armor systems and more specifically to light weight armor systems comprising layering non-metallic layers between metallic layers to protect against shape charges (e.g., an explosively formed penetrator (EPP)), other explosive devices, hypervelocity impacts and/or ballistic devices.

BACKGROUND

Improvised Explosive Devices (IEDs) and shape charges such as Explosively Formed Penetrators (EFPs) have accounted for a large number of combat casualties. Lethality of EFPs comes in part from the shape and arrangement of a concave copper cone, called the liner, which transforms into a forceful jet of fluidic metal which easily perforates steel armor. Despite focused efforts on armor development, Mine Resistant Ambush Protected (MRAP) vehicles and other armored vehicles still cannot defend against these threats. More recently, armor solutions such as the FRAG Kit 5 have been used to protect military vehicles such as Humvees. However, these armor solutions typically weigh around 200 lb/ft$^2$. Since nearly all army vehicles are thousands of pounds overweight, even without any additional armor protection solution, most of these approaches have proved impractical.

SUMMARY OF THE DISCLOSURE

According to some embodiments, an armor system comprises a plurality of metallic layers. The armor system further comprises a plurality of non-metallic layers located in between two or more metallic layers of the plurality of metallic layers, such that each non-metallic layer is located at a respective depth in the plurality of metallic layers.

According to some embodiments, thickness of the first metallic layer is greater than a thickness of the second metallic layer and the thickness of the second metallic layer is greater than a thickness of the third metallic layer. At least one of the metallic layers comprises steel. At least one of the non-metallic layers comprises plastic. Each metallic layer of the plurality of metallic layers is less than 0.25 inches thick.

According to some embodiments, each metallic layer of the plurality of metallic layers tears upon impact by a projectile. A length of a metallic channel formed by a projectile at each metallic layer is reduced.

Certain embodiments of the invention may provide one or more technical advantages. A technical advantage of one embodiment may include the capability to add a tumble to the path of a projectile device. A technical advantage of one embodiment may include the capability to change the trajectory of a projectile device. A technical advantage of one embodiment may include the capability to slow down particles of a projectile. A technical advantage of one embodiment may include the capability to withstand and resist multiple impacts from particles of a projectile device. A technical advantage of one embodiment may also include the capability to increase impact time. A technical advantage of one embodiment may also include the capability to lower the force exerted on one or more armor layers of an armor system. A technical advantage of one embodiment may also include the capability to decrease the overall impact of a projectile. A technical advantage of one embodiment may also include the capability to decrease the shape change ability of a projectile.

Further technical advantages of particular embodiments of the present disclosure may include an armor system that is lighter weight than conventional armor. A lightweight armor system of the present disclosure may be capable of protecting against a similar threat as a heavier conventional armor system. Yet another technical advantage of one embodiment may be a relatively low cost solution to provide protection against a variety of projectiles and high velocity impacts. In particular, armor systems comprising layering non-metallic layers between metallic layers in accordance with the present disclosure may protect against a shape charge such as an EFP, other explosive devices such as IED's, other projectile threats, bullets, ballistic threats and/or forms of hypervelocity impact.

Various embodiments of the invention may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present invention and its features and advantages, reference is now made to the following description, taken in conjunction with the accompanying drawings, in which:

FIGS. 3A and 3B shows an exemplary path of an explosively formed penetrator (EFP) through a prior art armor system not having non-metallic layers located between metallic layers, wherein, FIG. 3A depicts an example shallow-disk shaped EFP making contact with a first metallic layer located on an outer side of the armor system and FIG. 3B depicts the EFP now formed into a missile shaped structure as it penetrates through layers of prior art metallic layers; and FIGS. 4A, 4B and 4C illustrate an exemplary path of an EFP through one embodiment of an armor system of the disclosure as shown in FIG. 1 having non-metallic layers located between metallic layers wherein FIG. 4A depicts an example shallow-disk shaped EFP contacting an outer side of the armor system; FIG. 4B depicts the EFP as it penetrates through a first metallic layer which tears into a first non-metallic layer; and FIG. 4C illustrates the EFP as it penetrates through a second metallic layer which tears into a second non-metallic layer considerably slowing the impact and shape change ability of the EFP, according to one example embodiment.

DETAILED DESCRIPTION OF THE DISCLOSURE

Figure 1:
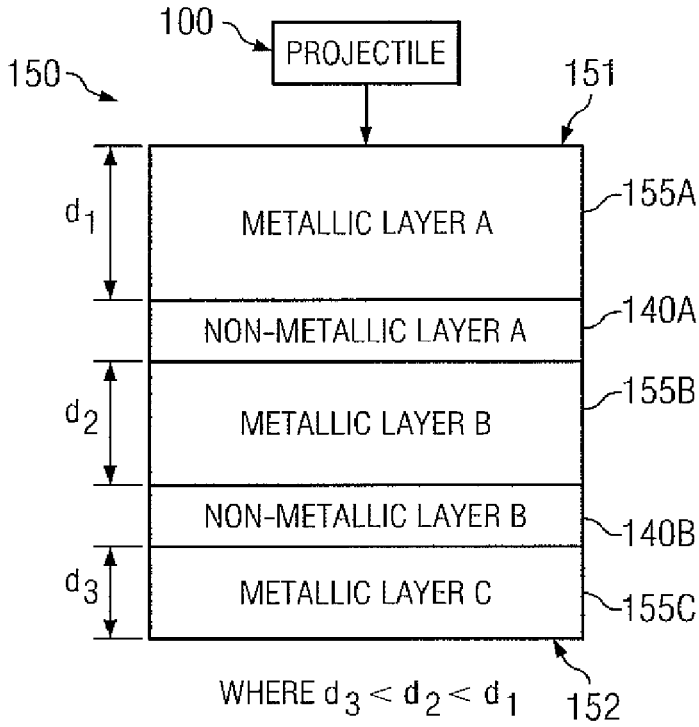
FIG. 1 shows an armor system having non-metallic layers layered between metallic layers, according to one example embodiment.

It should be understood at the outset that, although example implementations of embodiments of the invention are illustrated below, the present invention may be implemented using any number of techniques, whether currently known or not. The present invention should in no way be limited to the example implementations, drawings, and techniques illustrated below. Additionally, the drawings are not necessarily drawn to scale.

Teachings of certain embodiments recognize that armor systems may be used to provide protection against and/or reduce impact of various projectiles such as but not limited to shaped charges, explosively formed penetrators (EFPs), IEDs, ballistic devices, other explosives and hypervelocity impacts. Armor systems of the disclosure may be used in conjunction with any vehicle, such as but not limited to, military vehicles, convoy vehicles and/or personnel carriers and may be useful to protect personnel and equipment in war zones.

On the battlefield, shape charges such as EFPs, also known as explosively formed projectiles, pose serious threat to equipment and personnel. EFPs and other shape charges may have the ability to pierce through the armor of a vehicle and injure or kill the occupants inside.

Various configurations of shape charges and EFPs have been developed and several are capable of penetrating extremely thick and heavy armor. Therefore, merely adding more armor layers to protect against a shape charge may result in a vehicle that is overweight and less effective on the battlefield. In accordance with a particular embodiment of the present disclosure, a lightweight armor system may be capable of stopping a projectile or significantly reducing its destructive capability.

While not wishing to be bound to any particular theory, the present section provides a brief description of how high energy explosives and shape charges may achieve their lethality. High explosives may be extremely powerful because of their ability to rapidly release energy in the form of heat and pressurized gas. The extremely fast rate at which this energy may be discharged gives a high explosive its strength. Rapid discharge of a large amount of energy into a small space may generate shock waves. For example, rapidly released energy may compress neighboring air or surrounding material that further increase its velocity. The compressed air may then rapidly propagate outward and create a shock wave.

When a high explosive is detonated, an explosion may begin at a small portion at the edge of the explosive. This explosion may create a shock wave that may propagate through the rest of the explosive. When this shock wave comes in contact with a portion of the high explosive that has not yet exploded the shock wave detonates the unexploded explosive. Thus, the additional explosion causes the shock wave to increase in velocity.

By exploiting the properties of a high explosive, in conjunction with certain geometric configurations, a more powerful and more focused blast may be accomplished. Shape charges utilize properties of high explosives and a conical geometric shape, lined with a metal liner, to achieve an explosion that can reshape material from the metal liner into a penetrating configuration at the same time accelerating it by a high energy explosion.

Inertial forces of a material (e.g., metal from a metal liner) that are being propelled by an explosion from rest to a hypervelocity may affect the molecular structure of the material. A hypervelocity may be a velocity of over 6,700 miles per hour. Acceleration from rest to a hypervelocity generates extremely high inertial forces. These inertial forces may be significantly greater than the molecular forces holding the particular material together. As a result, the material may change its form and may convert from a solid to a liquid with the dominating inertial forces guiding the flow of the material.

EFPs and other shape charges use these principles while unleashing their explosive power. A shaped charge may be able to pierce a thickness of steel armor equal to six-times its diameter.

When a shape charge is detonated a shock wave that detonates the charge reaches the tip of its metal liner.

The liner tip may accelerate forward due to inertial forces and reach a hypervelocity changing the solid metal into a fluid. As the shock wave pushes the liner metal fluid towards center and since there is already metal occupying the center, the metal gets pushed out in two directions, some of the metal gets thrust in the direction of motion and becomes part of the jet or the penetrating portion of the shaped charge, while the rest of the metal gets pushed back towards the explosive and becomes part of the slug, the slow bulky portion of the shaped charge.

The remaining part of the conical liner may take the shape of a flat sheet and the shock wave may then impart additional momentum to the flat sheet giving it a final solid push. The shaped charge finally detaches from its casing.

The fluid metal has a varying velocity with length velocity decreasing farther down. For example, a jet tip of the fluid metal may be traveling much faster than a slug. The result may be an ultra-fine long penetrator traveling at an extremely high speed which may go through armor with a thickness of about six times the diameter of the charge. In accordance with one embodiment of the present disclosure, the speed of the tip of a shape charge may be substantially decreased by layering non-metallic layers between metallic layers within an armor system of the disclosure.

However, shaped charges are not as effective and efficient to pierce armor from a distance, since a jet of fluid material can continue to stretch and will eventually break apart before it, contacts a distant target.

An EFP is a specific type of shaped charge designed to pierce armor from a distance. A wide range of EFPs have been designed depending on the desired effect. An EFP structure may provide a distinct aerodynamic advantage over shaped charges. EFPs are typically shaped as semi-spherical dishes (rather than conical shapes as described above) that may be covered by a metal liner. The metal liner may be copper, or any other suitable metal that behaves similar to a fluid when subjected to extremely high inertial forces.

By having a more shallow dish shape an EFP jet does not become quite as concentrated as a shape charge jet described in sections above. Often an EFP metal becomes a single slug rather than a separate slug and jet. A minor jet may be present near the tip, but for the most part, the slug does not have a defined shape. EFPs typically have a larger slug that stays together better, but may have lower penetration attributes. For example, an EFP may be able to pierce a thickness of steel armor equal to the charge diameter. However, an EFP liner may be concentrated together such that the metal does not break apart before it reaches its target, making it efficient to strike distant targets.

As set forth earlier, geometry of the curvature of the liner before detonation may control the shape an EFP changes into after detonation. Particular shapes may be found to provide optimum aerodynamic and penetration attributes. The shape of an EFP may be important to its ability to penetrate. An EFP with a smaller surface area may penetrate easier. This may be the result of the higher stress that the EFP imparts over a smaller surface area of the armor it is penetrating. This may result in greater penetration. In accordance with one embodiment of the present disclosure, surface area of the tip of an EFP may be increased by layering non-metallic layers between metallic layers within an armor system. In some embodiments, increasing the surface area of the tip of an EFP may provide a technical advantage by making it easier to decrease and/or stop penetration by an EFP using a lightweight armor system.

An EFP may travel at hypervelocity regimes over 6,700 miles per hour. A shock wave that accelerates the metal liner to these types of velocities may cause the metal liner of an EFP to behave as if it were a fluid. Fluid effects caused by the inertial forces generated by the explosion may in part contribute to the EFPs ability to penetrate.

As the fluid from an EFP tip penetrates armor, the armor may exert a drag force upon the tip of the EFP. However, instead of transmitting this force throughout the entire EFP, as would occur if the EFP were a solid, the tip portion of the EFP that is subjected to the drag force, may fall away from the sides of a hole being created in the armor. Thus, instead of slowing down the entire EFP, only a small portion of the EFP may experience drag from the armor while the rest of the EFP maintains its velocity as it travels through the hole in the armor.

Additionally, as the portion of the metal tip gets dragged backwards by the armor, the EFP may reshape itself into a better penetrator. This may result when the edges of the EFP may be somewhat consumed as they are pushed to the rear of the EFP reshaping the EFP to become a thinner and more effective penetrator. For example, material from EFPs may be reshaped into a missile shape. The EFP, due to this reshaped form, effectively slides through the hole formed in the armor, as opposed to having large friction forces from the armor slow the entire EFP. Accordingly, an EFP effectively lubricates the armor walls through which it is penetrating and despite its poor initial shape, is effectively able to reshape and bore through thick armor. In some embodiments, an armor system having non-metallic layers layered between metallic layers according to some embodiments of the disclosure, may be able to reduce the reshaping ability of an EFP.

In addition, an EFP during its hypervelocity flight may split into a series of metal blobs or metal particles comprising leaders that are smaller, but travel faster and slugs which may be slower and bulkier. Several leader particles such as a primary leader and a secondary leader and several slugs such as a primary slug and a secondary slug may be present. A good EFP normally has all these metal particles well aligned with out a large pitch or yaw. Accordingly, an armor to protect form such an attack must be capable of withstanding multiple impacts.

Much of the lethal damage from an EFP is due to the behind armor effects (BAE). When an EFP penetrates armor, it may launch spell into the vehicle. Spell refers to the fragments of armor that the EFP may cause to break off and accelerate into the interior of the vehicle. This material may be extremely hot and may be moving at an extremely high velocity. As a result, these armor fragments may hit nearly everything within the personnel compartment of the vehicle and may cause extreme damage to the vehicle and equipment inside and injury or death to any occupants.

Damage from EFPs may also result from the overpressure blast that may send highly compressed air outwards at an extremely high velocity. The overpressure alone may cause blindness, deafness, and death. The overall effect of an EFP penetrating a vehicle may be similar to a fragmentation grenade being detonated within the vehicle.

In accordance with one embodiment of the present disclosure, an armor system having non-metallic layers located between metallic layers may be capable of significantly reducing destructive capability of a shape charge, an EFP, a high explosive, as well as any high velocity impact by slowing the speed of the respective projectile device.

FIG. 1 shows a projectile 100 and an exemplary armor system 150 comprising three metallic layers 155*a*, 155*b*, and 155*c*, and two non-metallic layers 140A and 140B, according to one example embodiment. However, teachings recognize using an additional number of metallic layers 155 and/or non-metallic layers 140 in armor system 150. In non-limiting examples, armor system 150 of the present disclosure may comprise three or more metallic layers 155.

Metallic layers 155 are generally used for armor against projectile 100. Metallic layers 155 may be a metallic sheet or panel. Metallic layers 155 may comprise a metal alloy. Non-limiting examples of metallic layers 155 may include steel, cast iron, titanium, etc. For example, steel makes for good armor because of its hardness and ductility. Steel may be able to flex backwards slightly, which may increase the impact time, while still providing the strength required to absorb energy of projectile 100. Although steel does a great job in reducing energy from projectile 100, the ductility of steel may have a negative effect for preventing the damage caused by projectile 100. When projectile 100 hits ductile steel, the steel may stretch backwards, which may cause two effects. First, the steel may create a very smooth channel that may allow the back parts of projectile to glide through. This smooth channel gliding through steel may help reshape projectile 100 with minimal energy loss and the new re-shaped projectile may have a larger critical dimension (length/diameter), which may allow projectile 100 to penetrate armor system 150 even easier. Second, the material directly behind the steel may be essentially wasted due to the steel stretching backwards. For example, several steel sheets layered consecutively may behave similar to one piece of steel, which may be susceptible to the formation of a ductile channel upon impact from projectile 100. In another example, a large piece of steel (e.g., thickness greater than 0.25 inches) with a polycarbonate backing may also be susceptible to the formation of a ductile channel upon impact from projectile 100. However, if a small piece of steel (e.g., thickness less than 0.25 inches), such as but not limited to sheet metal, is used as armor, a ductile channel may not be formed by projectile 100. Metallic layers 155 with a thickness of less than 0.25 inches may be more susceptible to tearing rather than stretching, which may reduce the length of a ductile channel being formed in metallic layers 155.

Metallic layers 155 placed next to non-metallic layers 140 may provide significant advantages as armor to projectile 100, especially if metallic layers 155 have a thickness less than 0.25 inches, such that metallic layers 155 are more prone to tearing than stretching out, which may prevent a ductile channel from forming by the impact of projectile 100. A single metallic layer 155A having a thickness less than 0.25 inches may not provide enough armor to projectile 100, but a plurality of metallic layers 155 separated by non-metallic layers 140 may provide enough armor to projectile 100. Non-metallic layers 140 placed between metallic layers 155 may allow for metallic layers 155 to act independently of one another. In some embodiments, placing a non-metallic layer 140 between two metallic layers 155 to create a distance of at least 0.1 inches between metallic layers 155 may result in optimum results.

In some embodiments, metallic layers 155 may comprise differing metal alloys. Numerous metal alloys may allow for different hardness and ductility properties to be achieved for different metallic layers 155. Teachings of certain embodiments recognize that using metallic layers 155 of differing metal alloys allow for unique designs for creating armor system 150 for stopping projectile 100. For example, metallic layers 155 having differing metal alloys may be used in concert to successfully slow down projectile 100 without increasing the critical dimension (length/diameter). Teachings of certain embodiments recognize that metallic layers 155 allow for putting a gradient of hardness into armor system 150, which may result in a decrease of weight of armor system 150.

Non-metallic layers 140 placed in between metallic layers 155 may prevent metallic layers 155 from acting as a solid metal block, where a solid metal block may facilitate the formation of a ductile channel by projectile 100. Non-metallic layers 155 may be used for ballistic protection or it may be a light weight material, such as but not limited to a polycarbonate. For example, thin plastic sheets may be placed in between thin metal sheets, which may reduce the length of a channel formed by the metal as a result of an impact with projectile 100. Non-Metallic layers 140 may be any material that does not comprise a metal alloy. Non-limiting examples of non-metallic layers 140 may include an air gap, a fiber made material, a non-metallic sheet, a non-metallic panel, etc. Teachings of certain embodiments recognize that non-metallic layers 140 allow for putting a gradient of hardness into armor system 150, which may result in a decrease of weight of armor system 150.

Air gaps may be comprised of air, of a gas, or of an easily yielding material. Exemplary gases that may be used may include any inert gas, argon, and oxygen.

An easily yielding material may be a soft material, such as but not limited to a polycarbonate (e.g., a light weight plastic). Non-limiting examples of an easily yielding materials may include a material that may have very little structural support, such as but not limited to Styrofoam and/or aerogels. An easily yielding material may be a material having strong structural support such as but not limited to carbonized hard steel. An easily yielding material in some embodiments may also include a naturally strong structural material for example a material comprising different shapes such as but not limited to honeycombs, cylinders, or pyramids. Use of several other easily yielding materials not expressly described herein are also contemplated and the present disclosure is not limited in any way to the examples listed.

Non limiting examples of fiber made materials may include e-glass, s-glass, an aramid fiber (such as Kevlar®), carbon nanotubes, carbon fibers, and combinations thereof.

As depicted in FIG. 1, metallic layer 140*a* has a thickness $d_1$, metallic layer 140*b* has a thickness of $d_2$, and metallic layer 140*c* has a thickness $d_3$, wherein $d_1>d_2>d_3$, according to one example embodiment. In some embodiments, armor system 150 may comprise additional metallic layers 155 (not expressly depicted) where in certain embodiments the thickness of each subsequent metallic layer 155 may be less than the thickness of metallic layer 155 preceding it. In some embodiments of armor system 150, the thickness of one or more metallic layers 155 may be equal. Some embodiments of armor system 150 may place two or more consecutive metallic layers 155 and/or non-metallic layers 140 next to one another.

In some embodiments, a non-metallic layer 140 may throw off the trajectory of an incoming projectile 100. For example, projectiles 100, which may often be missile shaped, although not necessarily limited to missile shaped objects, while penetrating through conventional armor systems, may be subjected to forces that may cause them to spin out of axis. However, since projectiles 100 may typically be fully constrained within the material of conventional armor systems, the projectile 100 may continue to stay aligned in its trajectory. However, when a projectile 100 is suddenly subjected to a non-metallic layer 140 in an armor system 150 in accordance with embodiments of present disclosure, the projectile 100 may gain a tumble.

Projectile 100 may be any high explosive device, such as but not limited to a shape charge, an EFP, an IED, a landmine, a high energy explosive, a ballistic device and/or any hypervelocity impact. However, teachings of certain embodiments recognize that armor system 150 may provide protection or mitigate the effects of any other projectile type that may be operable to penetrate armor.

As further depicted in FIG. 1, an outer side 151 of armor system 150 may refer to a side of armor system 150 that receives the initial impact of projectile 100. Accordingly, in the example embodiment depicted in FIG. 1, metallic layer 155*a* may correspond to a metallic layer located at a shallowest depth in armor system 150 and non-metallic layer 140*a* may refer to a first non-metallic layer located adjacent or toward outer side 151 (or toward a shallowest depth) of armor system 150. An inner side 152 of an armor system 150 of the disclosure may refer to a side of armor system 150 that is located away from the initial impact of projectile 100. Accordingly, in the example embodiment depicted in FIG. 1, metallic layer 155*c* may correspond to a deepest depth in armor system 150 and non-metallic layer 140*b* may refer to a second non-metallic layer 140*b* located adjacent or toward inner side 152 (or toward a deepest depth) of armor system 150.

FIG. 1 shows an example embodiment of an armor system 150 according to some embodiments of the disclosure. However, teachings recognize that other armor systems as described in the present disclosure may be made and/or modified and used.

Figure 2:
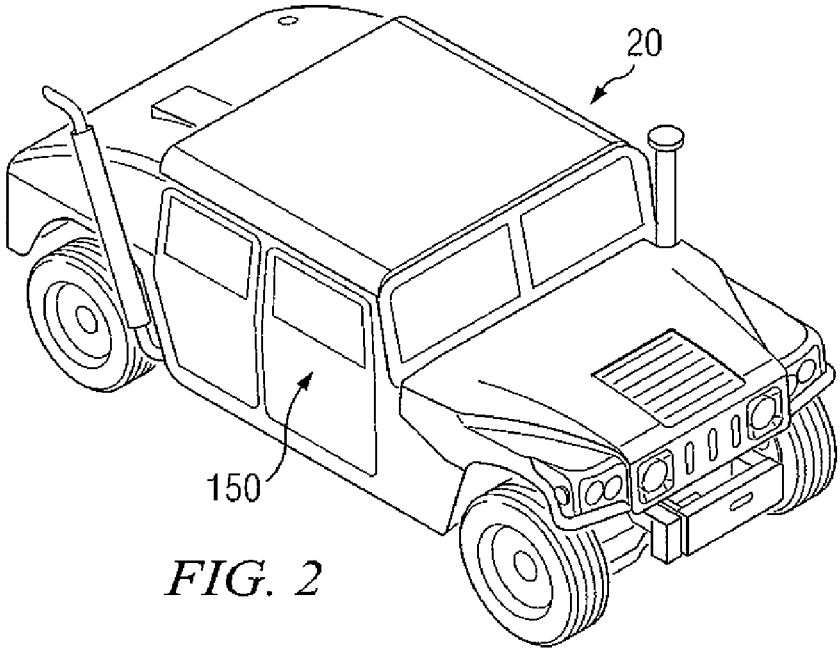
FIG. 2 shows a vehicle comprising an armor system of the disclosure, in accordance with one example embodiment.

FIG. 2 depicts a vehicle 20, such as but not limited to a military vehicle, that may be equipped with an armor system 150 having two or more non-metallic layers 140 located between two or more metallic layers 155 in accordance with the present disclosure. Armor system 150 may be located on exterior of vehicle 20. Occupants and equipment of vehicle 20 may be protected by armor system 150 from the penetrating effects of a projectile (not expressly depicted) which may target vehicle 20. Vehicle 20 may be maneuverable and effective on a battlefield while it is equipped with armor system 150 in accordance with embodiments of the present disclosure.

According to some embodiments, armor system 150 may comprise non-metallic layers 140 located between metallic layers 155 and may be from about 1 mm to several inches in thickness.

Other armor systems that do not employ layering non-metallic layers 140 between metallic layers 155 as taught herein may be considerably heavier and thicker. For example, conventional armor systems, without layering non-metallic layers 140 between metallic layers 155 as taught in the present application, may be many inches thick at a minimum. In another example, the mere addition of two metallic panels of armor to an existing conventional armor system may add an additional weight of about 20 $lb/ft^2$ or more depending on the type and size of metallic material used.

If vehicle 20 were equipped with any existing armor system or armor system solution, its maneuverability and effectiveness in protecting against projectiles 100 as described here may be diminished.

Figure 3A:
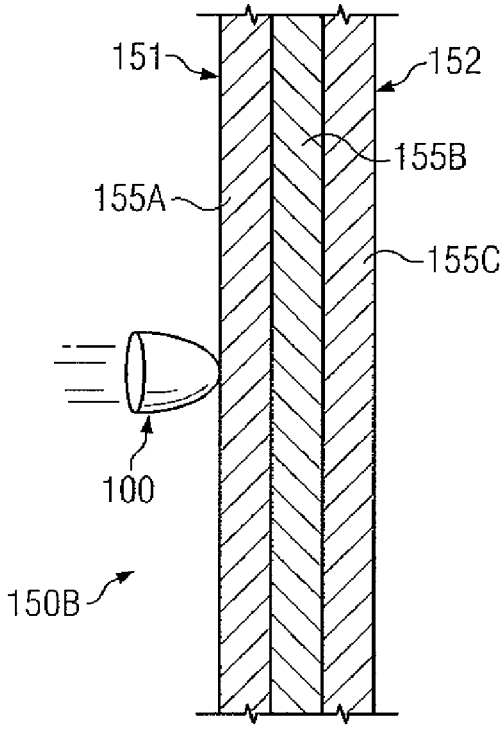
FIG. 3A (PRIOR ART)
Figure 3B:
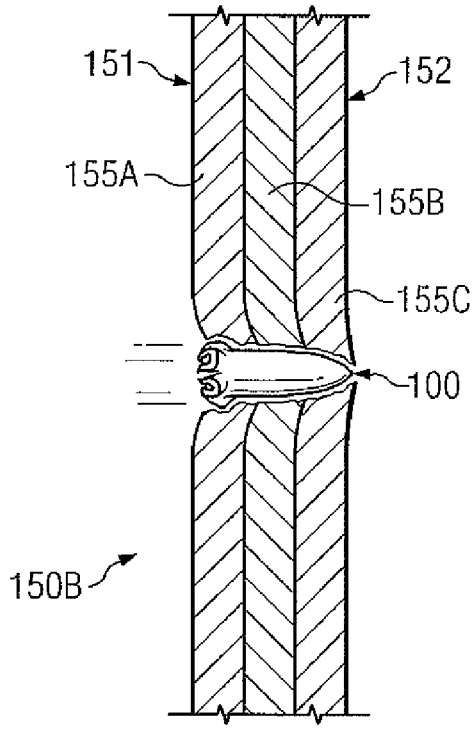
FIG. 3B (PRIOR ART)

FIG. 3A depicts an example shallow-disk shaped EFP 100 making contact with a first armor layer 155*a* of a prior art armor system 150*b* where first armor layer 155*a* is located on an outer side 151 of armor system 150*b*. FIG. 3B shows an exemplary path of EFP 100 through a prior art armor system 150*b* that does not have non-metallic layers layered between metallic layers. FIG. 3B depicts penetration through metallic layers 155*a*, 155*b*, and 155*c* by EFP 100. As depicted, EFP 100 is now reshaped into a missile shaped structure and slides through armor as it penetrates through layers of the prior art armor system 150*b*. Since EFP 100 may be fully constrained within metallic material of armor system 150*b* the EFP stays aligned on its trajectory through all the layers of the prior art armor system 150*b*. Furthermore, projectile 100 may form a ductile channel extending through all metallic layers 155*a*, 155*b*, and 155*c* in armor system 150*b*.

Figure 4A:
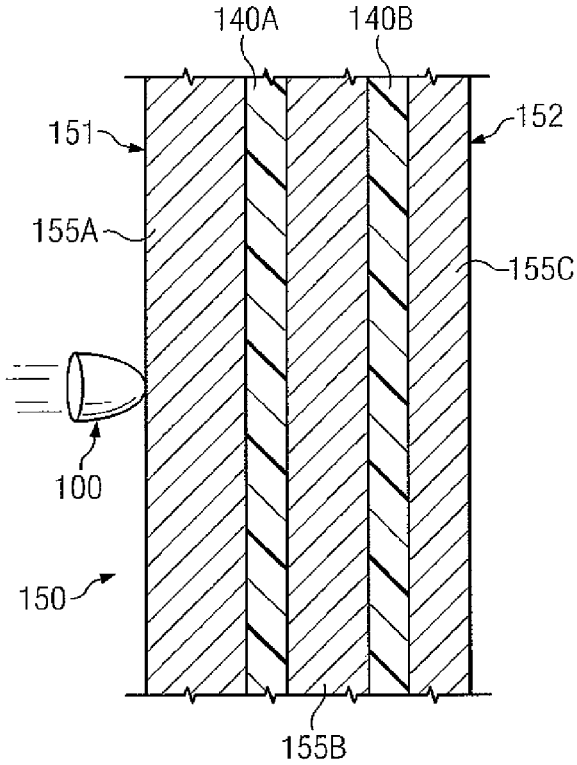
Figure 4B:
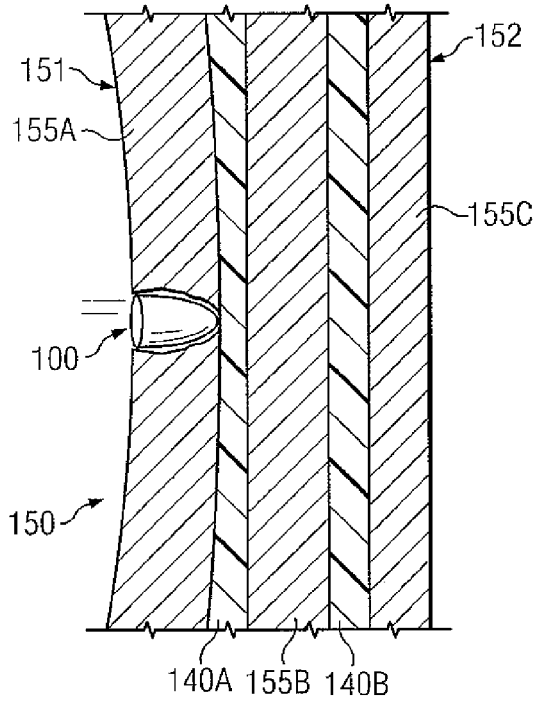
Figure 4C:
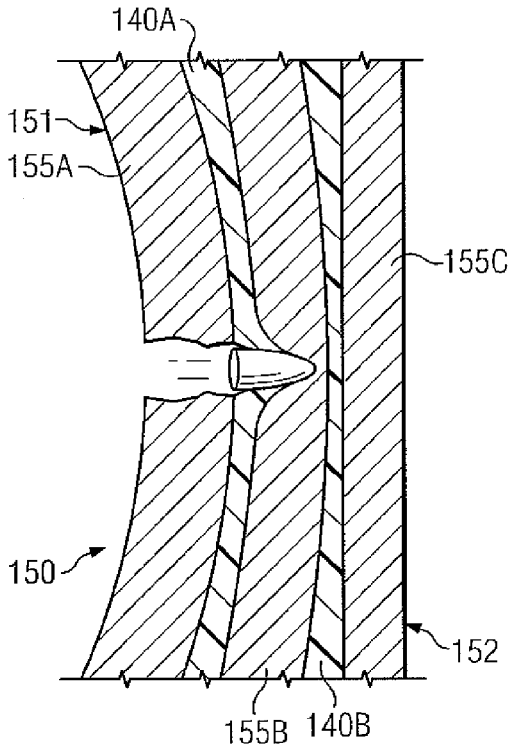

FIGS. 4A, 4B, and 4C illustrate an exemplary path of an EFP 100 through an armor system 150 having two non-metallic layers 140*a* and 140*b* and three metallic layers 155*a*, 155*b*, and 155*c*, according to one example embodiment of the disclosure. FIG. 4A shows shallow-disk shaped EFP 100 making initial contact with an outer side 151 of armor system 150. Armor system 150 is configured similar to exemplary armor system 150 shown in FIG. 1. In some embodiments, armor system 150 as shown in FIGS. 4A-4C may be comprised on the exterior of a vehicle 20.

FIG. 4B depicts penetration by EFP 100 into a first metallic layer 155*a* and shows tearing of the metallic layer 155*a* into a first non-metallic layer 140*a* in response to impact by EFP 100, but the tiny thickness of metallic layer 155*a* and the placement of the first non-metallic layer 140*a* may prevent EFP 100 from forming a channel in metallic layer 155*a* into the first non-metallic layer 140*a*. In some embodiments, flexing or tearing of metallic layer 155*a* may cause a tumble in the path of EFP 100 and/or throw EFP 100 off its trajectory and/or lower the force exerted on a following panel of armor 155*b*, and/or may increase the overall energy absorbed by the armor system 150 and/or may significantly slow EFP 100 and/or may slow reshaping ability of EFP 100. EFP 100, with the gained tumble, may re-collide with the next metallic layer 154*b* with a reduced penetration ability.

FIG. 4C illustrates EFP 100 penetrating through a second metallic layer 154*b* and shows flexing or tearing of second metallic layer 154*b* into a second non-metallic layer 140*b*, but the tiny thickness of metallic layer 155*b* and the placement of the second non-metallic layer 140*b* may prevent EFP 100 from forming a channel in metallic layer 154*b* that goes through the second non-metallic layer 140*b*. In some embodiments, passing through second non-metallic layer 140*b* may further add tumble and/or reduce speed and/or impact and/or shape change ability and/or destructive ability of EFP 100. In some embodiments, impacts with two or more metallic layers 155 and two or more non-metallic layers 140 may render EFP 100 unable or ineffective to penetrate metallic layer 155*c* leaving the occupants and equipment behind metallic layer 155*c* protected. In some embodiments, one or more metallic layers 155 and/or non-metallic layers 140 may increase the overall energy absorption capacity of armor system 150.

Modifications, additions, or omissions may be made to the systems and apparatuses described herein without departing from the scope of the invention. The components of the systems and apparatuses may be integrated or separated. Moreover, the operations of the systems and apparatuses may be performed by more, fewer, or other components. The methods may include more, fewer, or other steps. Additionally, steps may be performed in any suitable order. Additionally, operations of the systems and apparatuses may be performed using any suitable logic. As used in this document, "each" refers to each member of a set or each member of a subset of a set.

Although several embodiments have been illustrated and described in detail, it will be recognized that substitutions and alterations are possible without departing from the spirit and scope of the present invention, as defined by the appended claims.

To aid the Patent Office, and any readers of any patent issued on this application in interpreting the claims appended hereto, applicants wish to note that they do not intend any of the appended claims to invoke paragraph 6 of 35 U.S.C. §112 as it exists on the date of filing hereof unless the words "means for" or "step for" are explicitly used in the particular claim.

What is claimed is:

1. An armor system comprising:

a plurality of metallic layers; and a plurality of non-metallic solid material layers located in between two or more metallic layers of the plurality of metallic layers, each non-metallic solid material layer located at a respective depth in the plurality of metallic layers;

wherein each metallic layer of the plurality of metallic layers is spaced at least 0.1 inches apart;

wherein at least a first metallic layer of the plurality of metallic layers is located at an outer side of the armor system, the outer side being located toward a projectile impact site;

wherein at least a first non-metallic solid material layer of the plurality of non-metallic solid material layers is located at a first depth from the outer side of the armor system;

wherein at least a second metallic layer of the plurality of the metallic layers is located at a second depth from the outer side of the armor system;

wherein at least a second non-metallic solid material layer of the plurality of non-metallic solid material layers is located at a third depth from the outer side;

wherein at least a third metallic layer of the plurality of the metallic layers is located at a fourth depth from the outer side;

wherein the second depth is greater than the first depth, the third depth is greater than the second depth, and the fourth depth is greater than the third depth; and wherein a thickness of the first metallic layer is greater than a thickness of the second metallic layer and the thickness of the second metallic layer is greater than a thickness of the third metallic layer.

2. The armor system of claim 1, wherein at least one of the metallic layers comprises steel.

3. The armor system of claim 1, wherein at least one of the non-metallic solid material layers comprises plastic.

4. The armor system of claim 1, wherein each metallic layer of the plurality of metallic layers is less than 0.25 inches thick.

5. The armor system of claim 1, wherein a length of a channel formed by a projectile at each metallic layer is reduced.

6. The armor system of claim 1, operable to improve resistance to impact by a shape charge, an explosively formed penetrator (EFP), an improvised explosive device (IED), a ballistic device, or a hypervelocity impact.

* * * * *